US008046225B2

(12) United States Patent
Masuko et al.

(10) Patent No.: US 8,046,225 B2
(45) Date of Patent: Oct. 25, 2011

(54) PROSODY-PATTERN GENERATING APPARATUS, SPEECH SYNTHESIZING APPARATUS, AND COMPUTER PROGRAM PRODUCT AND METHOD THEREOF

(75) Inventors: Takashi Masuko, Kanagawa (JP); Masami Akamine, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 893 days.

(21) Appl. No.: 12/068,600

(22) Filed: Feb. 8, 2008

(65) Prior Publication Data

US 2008/0243508 A1 Oct. 2, 2008

(30) Foreign Application Priority Data

Mar. 28, 2007 (JP) ..... 2007-085981

(51) Int. Cl.
*G10L 13/08* (2006.01)

(52) U.S. Cl. ..... 704/258; 704/9; 704/260; 704/268

(58) Field of Classification Search ..... 704/9, 258, 704/260, 268
See application file for complete search history.

(56) References Cited

U.S. PATENT DOCUMENTS 5,845,047 A 12/1998 Fukada et al.
2008/0059190 A1* 3/2008 Chu et al. ..... 704/258

FOREIGN PATENT DOCUMENTS

JP 05-232991 9/1993
JP 07-261778 10/1995
JP 2005-221785 8/2005
JP 2007-033870 2/2007

OTHER PUBLICATIONS

M. Tamura et al. "Adaptation of Pitch and Spectrum for HMM-Based Speech Synthesis Using MLLR" Proc. ICASSP, 2001, pp. 805-808.*
X. Huang et al. "Recent improvements on microsoft's trainable text-to-speech synthesizer: Whistler" ICASSP, 1997, pp. 959-962.*
Ling et al. "USTC system for Blizzard Challenge 2006 an improved HMM-based speech synthesis method" In Blizzard Challenge Workshop, 2006.*
Plumpe et al. "HMM-Based Smoothing for Concatenative Speech Synthesis" ICSLP, 1998.*
Yoshimura, T. et al., "Simultaneous Modeling of Spectrum, Pitch and Duration in HMM-Based Speech Synthesis", ESCA, Eurospeech99, pp. 2347-2350, (1999).
Toda, T. et al., "Speech Parameter Generation Algorithm Considering Global Variance for HMM-Based Speech Synthesis", Interspeech 2005, pp. 2801-2804, (2005).
Office Action dated Aug. 4, 2009 in JP Application No. 2007-085981 and partial English-language translation thereof.

* cited by examiner

*Primary Examiner* — Vincent P Harper
(74) *Attorney, Agent, or Firm* — Nixon & Vanderhye, P.C.

(57) ABSTRACT

Normalization parameters are generated at a normalization-parameter generating unit by calculating the mean values and the standard deviations of an initial prosody pattern and a prosody pattern of a training sentence of a speech corpus. Then, the variance range or variance width of the initial prosody pattern is normalized at the prosody-pattern normalizing unit in accordance with the normalization parameters. As a result, a prosody pattern similar to speech of human beings and improved in naturalness can be generated with a small amount of calculation.

7 Claims, 4 Drawing Sheets

PROSODY-PATTERN GENERATING APPARATUS, SPEECH SYNTHESIZING APPARATUS, AND COMPUTER PROGRAM PRODUCT AND METHOD THEREOF

CROSS-REFERENCE TO RELATED APPLICATIONS

This application is based upon and claims the benefit of priority from the prior Japanese Patent Application No. 2007-85981, filed on Mar. 28, 2007; the entire contents of which are incorporated herein by reference.

BACKGROUND OF THE INVENTION

1. Field of the Invention

The present invention relates to a prosody-pattern generating apparatus, a speech synthesizing apparatus, and a computer program product and a method thereof.

2. Description of the Related Art

A technique of applying a hidden Markov model (HMM), which is used in speech recognition, to speech synthesizing technology of synthesizing speech from a text has been receiving attention. In particular, a speech is synthesized by generating a prosody pattern (fundamental frequency pattern and phoneme duration length pattern) that defines the characteristics of speech by use of a prosody model, which is an HMM (see, for instance, Non-patent Document 1 of "Simultaneous modeling of spectrum, pitch and duration in HMM-based speech synthesis" by T. Yoshimura, K. Tokuda, T. Masuko, T. Kobayashi, and T. Kitamura, Proc. EUROSPEECH '99, pp. 2347-2350, September 1999).

With the speech synthesizing technology of outputting speech parameters by use of an HMM itself and thereby synthesizing a speech, various speech styles of various speakers can be readily realized.

In addition to the above HMM-based fundamental frequency pattern generation, a technique has been suggested, with which the naturalness of a fundamental frequency pattern can be improved by generating the pattern in consideration of the distribution of fundamental frequencies of the entire sentence (see, for instance, Non-patent Document 2 of "Speech parameter generation algorithm considering global variance for HMM-based speech synthesis" by T. Toda and K. Tokuda, Proc. INTERSPEECH 2005, pp. 2801-2804, September 2005).

However, there is a problem in the technique suggested by Non-patent Document 2. Because optimal parameter strings are searched for by repeatedly using algorithms, an amount of calculation increases at the time of generating the fundamental frequency pattern.

Furthermore, because the technique of Non-patent Document 2 employs the distribution of the fundamental frequencies of the entire text sentence, a pattern cannot be generated sequentially for each segment of the sentence or the like. Thus, there is a problem that the speech cannot be output until the fundamental frequency pattern of the entire text is completed.

SUMMARY OF THE INVENTION

According to one aspect of the present invention, a prosody-pattern generating apparatus includes an initial-prosody-pattern generating unit that generates an initial prosody pattern based on language information and a prosody model which is obtained by modeling prosody information in units of phonemes, syllables and words that constitute speech data; a normalization-parameter generating unit that generates, as normalization parameters, mean values and standard deviations of the initial prosody pattern and a prosody pattern of a training sentence included in a speech corpus, respectively; a normalization-parameter storing unit that stores the normalization parameters; and a prosody-pattern normalizing unit that normalizes a variance range or a variance width of the initial prosody pattern in accordance with the normalization parameters.

According to another aspect of the present invention, a speech synthesizing apparatus includes a prosody-model storing unit that stores a prosody model in which prosody information is modeled in units of phonemes, syllables and words that constitute speech data; a text analyzing unit that analyzes a text that is input thereto and outputs language information; the prosody-pattern generating apparatus according to claim 1 that generates a prosody pattern that indicates characteristics of a manner of speech in accordance with the language information by using the prosody model; and a speech synthesizing unit that synthesizes speech by using the prosody pattern.

According to still another aspect of the present invention, a prosody-pattern generating method includes generating an initial prosody pattern based on language information and a prosody model which is obtained by modeling prosody information in units of phonemes, syllables and words that constitute speech data; generating, as normalization parameters, mean values and standard deviations of the initial prosody pattern and a prosody pattern of a training sentence included in a speech corpus, respectively; storing the normalization parameters in a storing unit; and normalizing a variance range or a variance width of the initial prosody pattern in accordance with the normalization parameters.

A computer program product according to still another aspect of the present invention causes a computer to perform the method according to the present invention.

DETAILED DESCRIPTION OF THE INVENTION

Exemplary embodiments of a prosody-pattern generating apparatus, a speech synthesizing apparatus and a computer program product and a method thereof according to the present invention are explained below with reference to the attached drawings.

Figure 1:
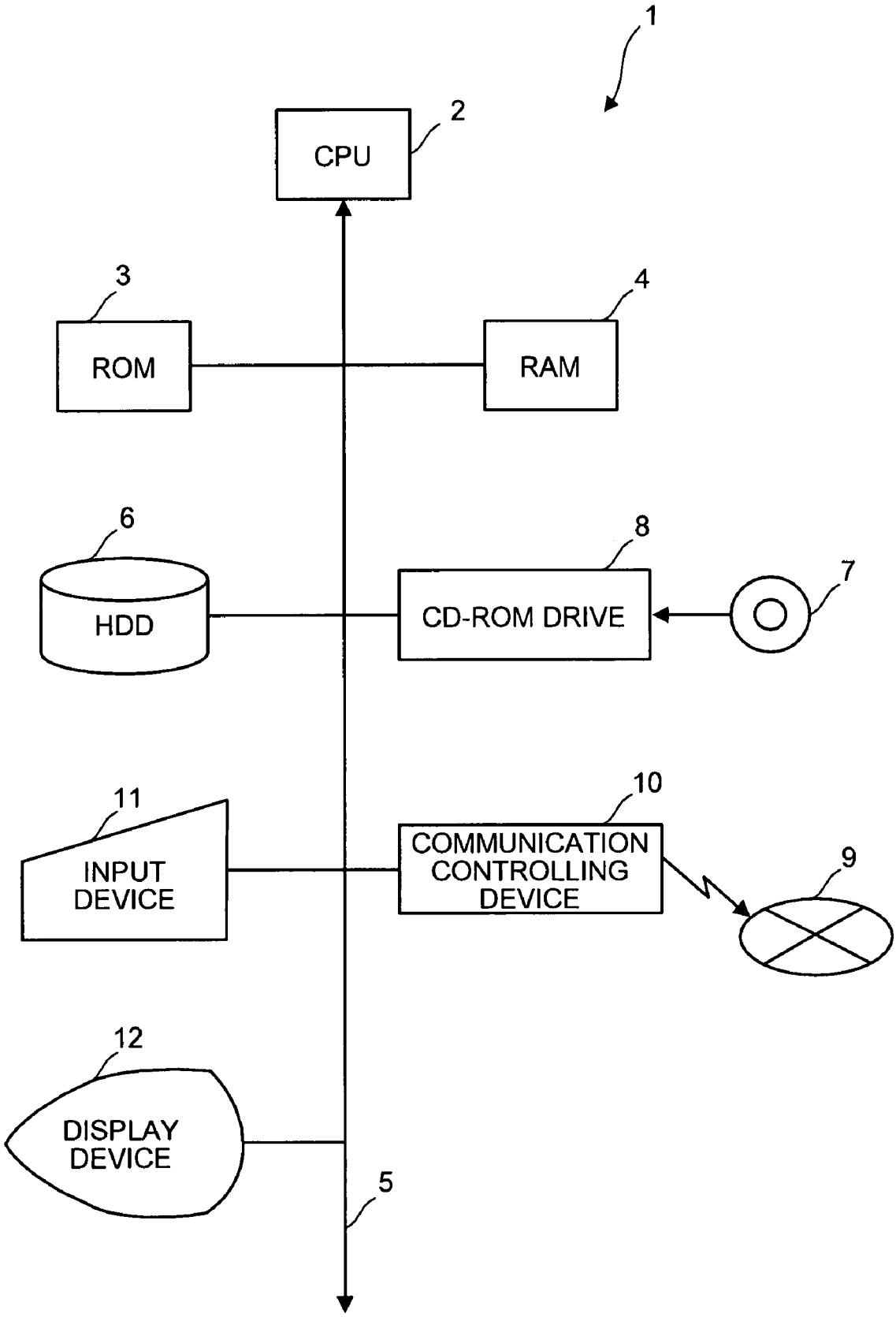
FIG. 1 is a block diagram of a hardware structure of a speech synthesizing apparatus according to an embodiment of the present invention.

An embodiment of the present invention is now explained with reference to FIGS. 1 to 5. FIG. 1 is a block diagram of a hardware structure of a speech synthesizing apparatus 1 according to the embodiment of the present invention. Fundamentally, the speech synthesizing apparatus 1 according to the embodiment is configured to perform a speech synthesizing process to synthesize speech from a text by use of a hidden Markov model (HMM).

As shown in FIG. 1, the speech synthesizing apparatus 1 may be a personal computer, which includes a central processing unit (CPU) 2 that serves as a principal component of the computer and centrally controls other units thereof. A read only memory (ROM) 3 storing therein BIOS and the like, and a random access memory (RAM) 4 storing therein various kinds of data in a rewritable manner are connected to the CPU 2 by way of a bus 5.

Furthermore, a hard disk drive (HDD) 6 that stores therein various programs and the like, a CD (compact disc)-ROM drive 8 that serves as a mechanism of reading computer software, which is a distributed program, and reads a CD-ROM 7, a communication controlling device 10 that controls communications between the speech synthesizing apparatus 1 and a network 9, an input device 11 such as a keyboard and a mouse with which various operations are instructed, and a display device 12, such as a cathode ray tube (CRT) and a liquid crystal display (LCD), which displays various kinds of information, are connected to the bus 5 by way of a not-shown I/O.

The RAM 4 has a property of storing therein various kinds of data in a rewritable manner, and thus offers a work area to the CPU 2, serving as a buffer.

The CD-ROM 7 illustrated in FIG. 1 embodies the recording medium of the present invention, in which an operating system (OS) and various programs are recorded. The CPU 2 reads the programs recorded in the CD-ROM 7 on the CD-ROM drive 8 and installs them on the HDD 6.

Not only the CD-ROM 7 but also various optical disks such as a DVD, various magneto-optical disks, various magnetic disks such as a flexible disk, and media of various systems such as a semiconductor memory may be adopted as a recording medium. Further, programs may be downloaded through the network 9 such as the Internet by way of the communication controlling device 10 and installed on the HDD 6. If this is the case, the storage device of the server on the transmission side that stores therein the programs is also included in the recording medium of the present invention. The programs may be of a type that runs on a specific operating system (OS), which may perform some of various processes, which will be discussed later, or the programs may be included in the program file group that forms a specific application software program or the OS.

The CPU 2 that controls the operation of the entire system executes various processes based on the programs loaded into the HDD 6, which is used as a main storage of the system.

Among the functions realized by the CPU 2 in accordance with the programs installed in the HDD 6 of the speech synthesizing apparatus 1, characteristic functions of the speech synthesizing apparatus 1 according to the embodiment is now explained.

Figure 2:
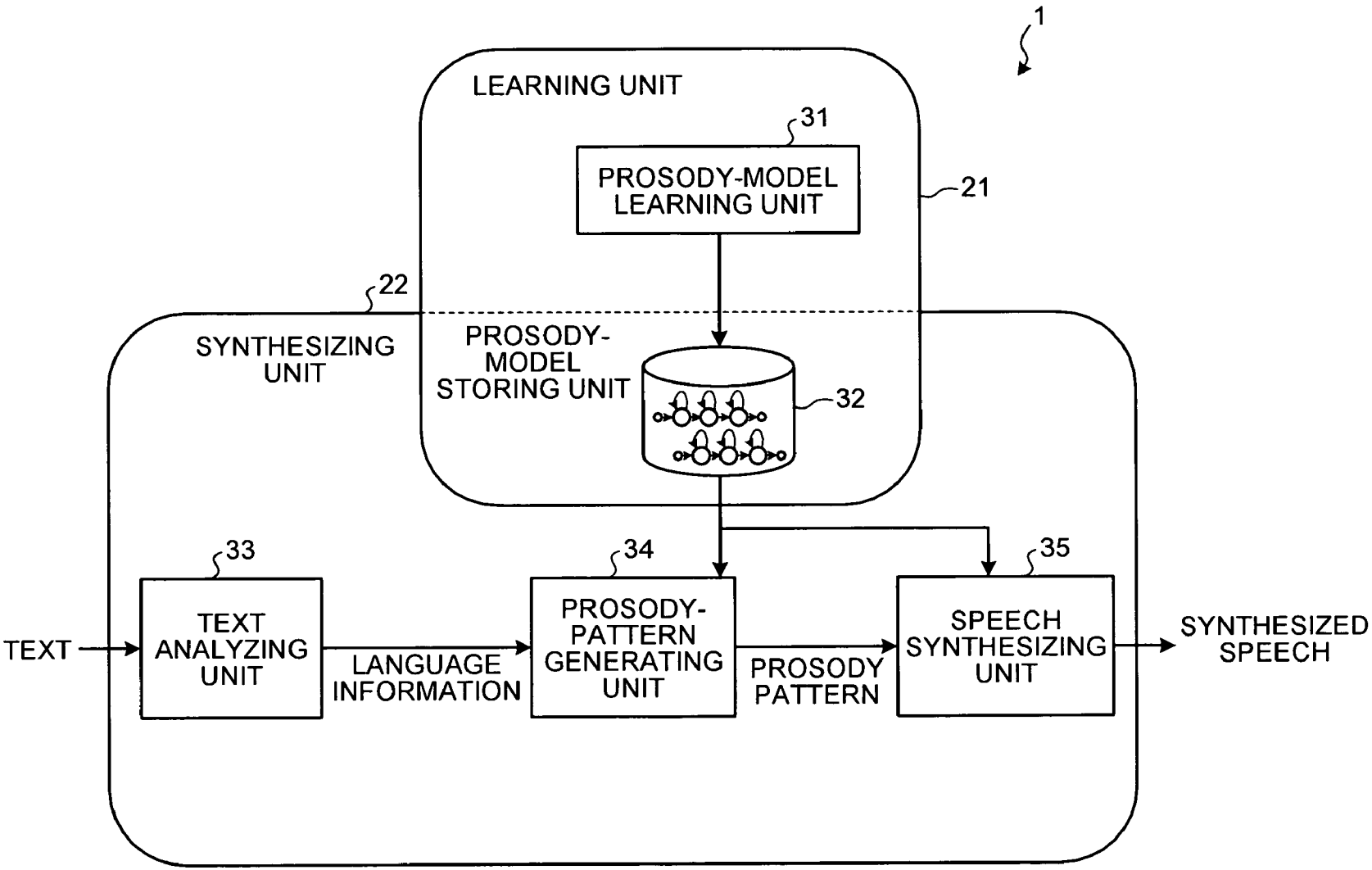
FIG. 2 is a block diagram of a functional structure of the speech synthesizing apparatus.

FIG. 2 is a block diagram of a functional structure of the speech synthesizing apparatus 1. When the speech synthesizing apparatus 1 executes a speech synthesizing program, a learning unit 21 and a synthesizing unit 22 are realized therein. The following is a brief explanation of the learning unit 21 and the synthesizing unit 22.

Figure 3:
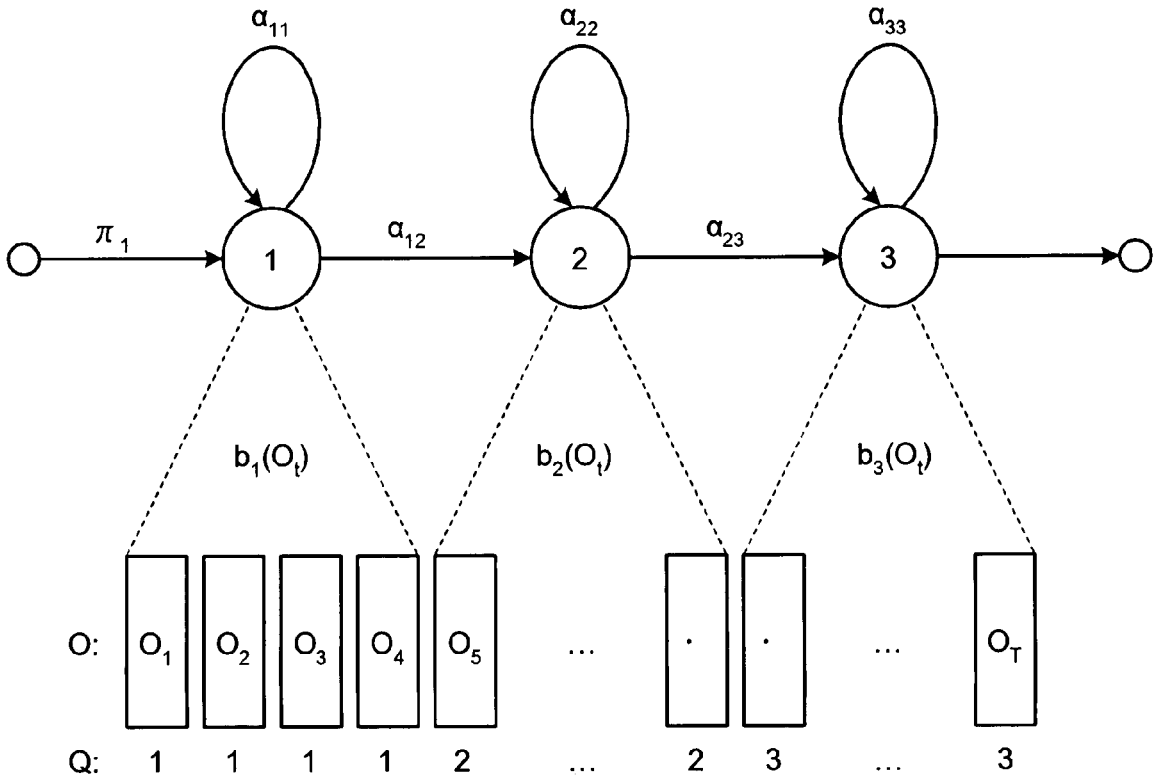
FIG. 3 is a schematic diagram illustrating an example of an HMM.

The learning unit 21 includes a prosody-model learning unit 31 and a prosody-model storing unit 32. The prosody-model learning unit 31 conducts training in relation to parameters of prosody models (HMMs). For this training, speech data, phoneme label strings, and language information are required. As shown in FIG. 3, a prosody model (HMM) is defined as signal sources (states) where the probability distribution of outputting an output vector $o_t$ is $b_i(o_t)$ that are combined under the state transition probability $a_{ij}=P(q_t=j|q_{t-1}=i)$. Each of i and j denotes a state number. The output vector $o_t$ is a parameter that expresses a short-time speech spectrum and fundamental frequency. In such an HMM, state transitions in the time direction and parameter direction are statistically modeled, and thus the HMM is suitable for expressing speech parameters that vary due to different factors. For modeling of the fundamental frequency, a probability distribution of different space is adopted. Model parameter learning in the HMM is a known technology and thus the explanation thereof is omitted. In the above manner, the prosody model (HMM) in which a string of parameters of phonemes that form the speech data is modeled is generated by the prosody-model learning unit 31, and stored in the prosody-model storing unit 32.

The synthesizing unit 22 includes a text analyzing unit 33, a prosody-pattern generating unit 34, which is a prosody-pattern generating apparatus, and a speech synthesizing unit 35. The text analyzing unit 33 analyzes a Japanese text that is input therein and outputs language information. Based on the language information obtained through the analysis by the text analyzing unit 33, the prosody-pattern generating unit 34 generates prosody patterns (a fundamental frequency pattern and a phoneme duration length pattern) that determine characteristics of the speech by use of the prosody models (HMMs) stored in the prosody-model storing unit 32. The technique described in Non-patent Document 1 may be adopted for the generation of the prosody patterns. The speech synthesizing unit 35 synthesizes speech based on the prosody patterns generated by the prosody-pattern generating unit 34 and outputs the synthesized speech.

The prosody-pattern generating unit 34 that performs the characteristic function of the speech synthesizing apparatus 1 according to the embodiment is now described.

Figure 4:
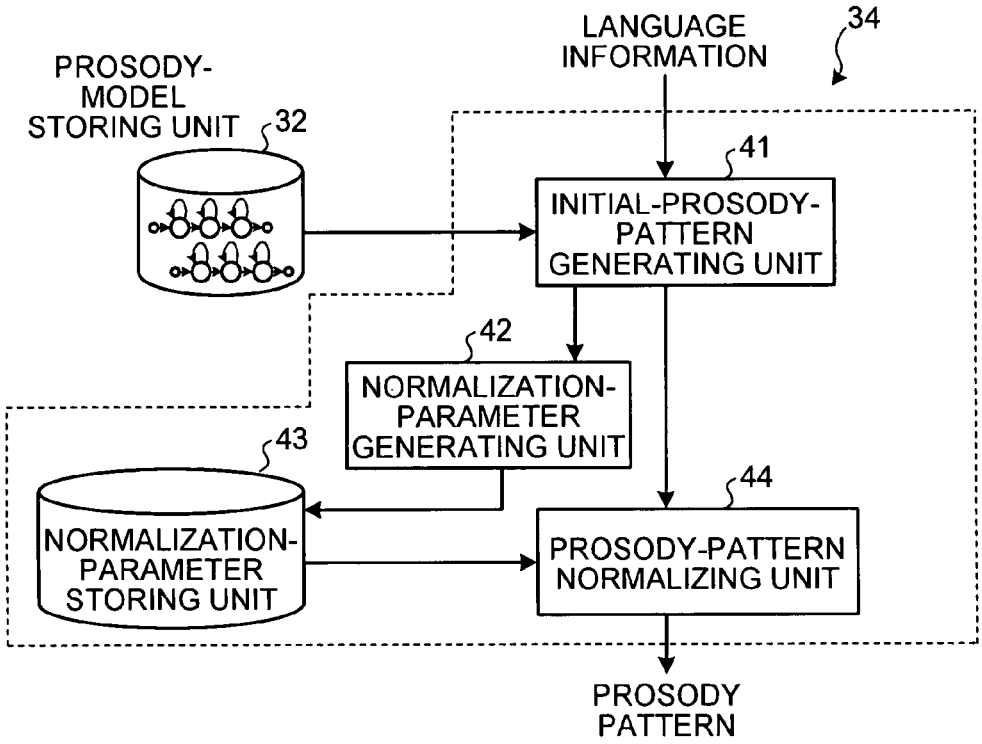
FIG. 4 is a block diagram of a functional structure of a prosody-pattern generating unit.

FIG. 4 is a block diagram of the functional structure of the prosody-pattern generating unit 34. The prosody-pattern generating unit 34 includes an initial-prosody-pattern generating unit 41, a normalization-parameter generating unit 42, a normalization-parameter storing unit 43, and a prosody-pattern normalizing unit 44.

The initial-prosody-pattern generating unit 41 generates an initial prosody pattern from the prosody models (HMMs) that are stored in the prosody-model storing unit 32 and the language information (either language information obtained from the text analyzing unit 33 or language information for the normalization parameter training).

The normalization-parameter generating unit 42 uses a speech corpus for normalization parameter training to generate normalization parameters for normalizing the initial prosody pattern. The speech corpus is a database created by cutting a preliminarily recorded speech waveform into phonemes and individually defining the phonemes.

Figure 5:
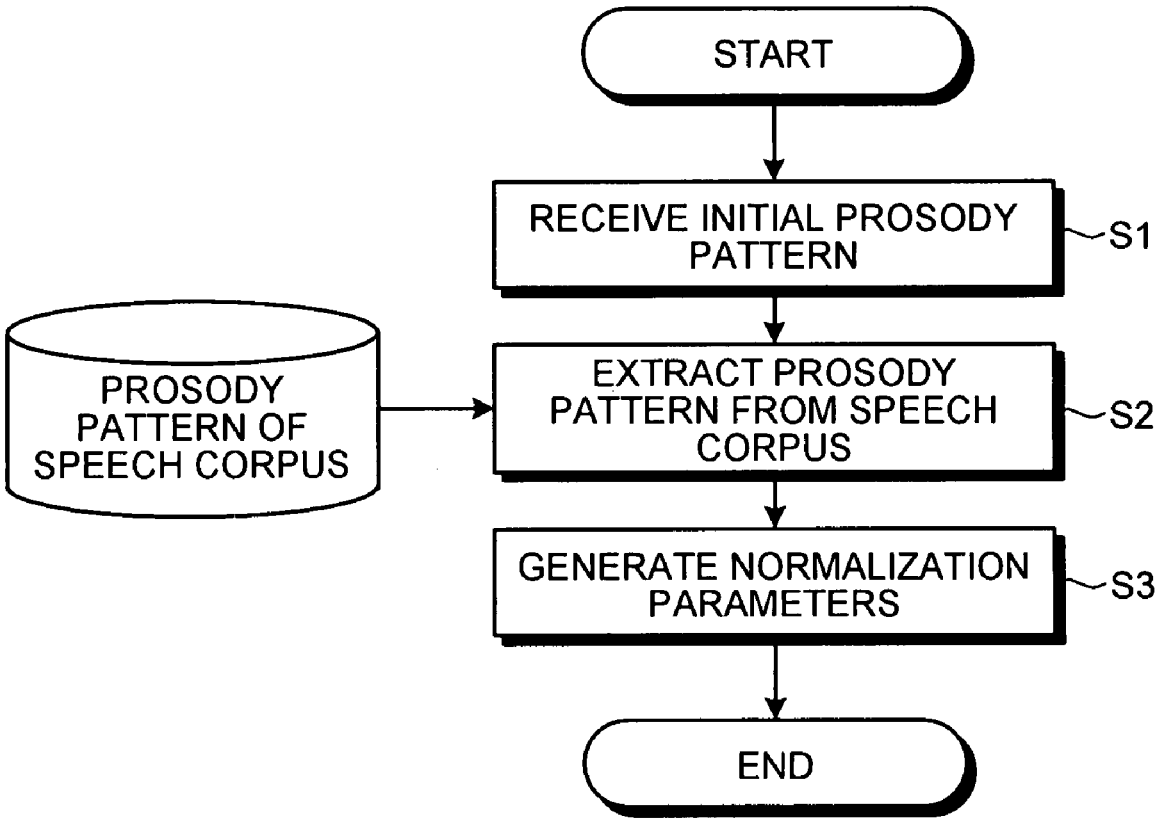
FIG. 5 is a flowchart of a process of generating a normalization parameter.

FIG. 5 is a flowchart of a process of generating a normalization parameter. As shown in FIG. 5, the normalization-parameter generating unit 42 receives, from the initial prosody-pattern generating unit 41, an initial prosody pattern that is generated in accordance with the language information for normalization parameter training (step S1). Next, the normalization-parameter generating unit 42 extracts prosody patterns of a training sentence from a speech corpus intended for normalization parameter training that corresponds to the language information for normalization parameter training (step S2). The training sentence of the speech corpus does not have to fully match the language information for training. At step S3, normalization parameters are generated. The normalization parameters are the mean values and standard deviations of the initial prosody pattern received at step S1 and of the prosody patterns of the training sentence extracted at step S2 from the speech corpus for normalization parameter training that corresponds to the language information.

The normalization-parameter storing unit 43 stores therein the normalization parameters that are generated by the normalization-parameter generating unit 42.

The prosody-pattern normalizing unit 44 normalizes the variance range or the variance width of the initial prosody pattern generated by the initial-prosody-pattern generating unit 41 in accordance with the normalization parameters stored in the normalization-parameter storing unit 43, by use of the prosody models (HMMs) stored in the prosody-model storing unit 32 and the language information (the language information provided by the text analyzing unit 33). In other words, the prosody-pattern normalizing unit 44 normalizes the variance range or the variance width of the initial prosody pattern generated by the initial-prosody-pattern generating unit 41 to bring it to the same level as the variance range or the variance width of the training sentence prosody patterns of the speech corpus.

The normalization process is now explained. When the variance range of the initial prosody pattern is to be normalized, the following equation is employed for normalization.

$$F(n)=(f(n)-m_g)/\sigma_g\times\sigma_t+m_t$$

wherein:

f(n) is a value of the initial prosody pattern at the nth sample point;

F(n) is a value of the prosody pattern after the normalization;

$m_t$ is the mean value of the prosody patterns of the training sentences;

$\sigma_t$ is the standard deviation of the prosody patterns of the training sentences;

$m_g$ is the mean value of the initial prosody patterns; and $\sigma_g$ is the standard deviation of the initial prosody patterns.

On the other hand, when the variance width of the initial prosody pattern is to be normalized, the following equation is employed for normalization.

$$F(n)=(f(n)-m_g)/\sigma_g\times\sigma_t+m_g$$

In this equation, the normalization parameters, $m_t$, $\sigma_t$, $m_g$, and $\sigma_g$ may be given different values for different attributes of sound (such as phonemes, moras, and accented phrases). In this case, the variation of the normalization parameters should be smoothed at each sample point by employing a linear interpolation technique or the like.

According to the embodiment, the mean values and the standard deviations are calculated for the initial prosody pattern and the prosody patterns of the training sentences of the speech corpus and adopted as normalization parameters. The variance range or the variance width of the initial prosody pattern is normalized in accordance with these normalization parameters. This makes the speech sound similar to the speech of human beings and improves naturalness thereof, while reducing the amount of calculation when generating prosody patterns.

In addition, the normalization parameters, which are the mean values and the standard deviations of the initial prosody pattern and of the prosody patterns of the training sentence of the speech corpus, are independent from the initial prosody pattern. Thus, the process is conducted for each sample point, and the speech can be output successively in units of phonemes, words, or sentence segments.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A prosody-pattern generating apparatus comprising:

an initial-prosody-pattern generating unit that generates an initial prosody pattern based on language information and a prosody model which is obtained by modeling prosody information in units of phonemes, syllables and words that constitute speech data;

a normalization-parameter generating unit that generates, as normalization parameters, mean values and standard deviations of the initial prosody pattern and a prosody pattern of a training sentence included in a speech corpus, respectively;

a normalization-parameter storing unit that stores the normalization parameters; and a prosody-pattern normalizing unit that normalizes a variance range or a variance width of the initial prosody pattern, bringing the variance range or the variance width of the initial prosody pattern to the same level as a variance range or a variance width of the prosody pattern of the training sentence in the speech corpus in accordance with the normalization parameters.

2. The apparatus according to claim 1, wherein the normalization parameters generated by the normalization-parameter generating unit have different values for units of phonemes, syllables and words that constitute speech data.

3. The apparatus according to claim 1, wherein the prosody information is a basic frequency.

4. The apparatus according to claim 1, wherein the prosody model is a hidden Markov model (HMM).

5. A speech synthesizing apparatus comprising:

a prosody-model storing unit that stores a prosody model in which prosody information is modeled in units of phonemes, syllables and words that constitute speech data;

a text analyzing unit that analyzes a text that is input thereto and outputs language information;

the prosody-pattern generating apparatus according to claim 1 that generates a prosody pattern that indicates characteristics of a manner of speech in accordance with the language information by using the prosody model; and a speech synthesizing unit that synthesizes speech by using the prosody pattern.

6. A computer program product having a non-transitory computer readable medium storing programmed instructions for generating a prosody pattern, wherein the instructions, when executed by a computer, cause the computer to perform:

generating an initial prosody pattern based on language information and a prosody model which is obtained by modeling prosody information in units of phonemes, syllables and words that constitute speech data;

generating, as normalization parameters, mean values and standard deviations of the initial prosody pattern and a prosody pattern of a training sentence included in a speech corpus, respectively;

storing the normalization parameters in a storing unit; and normalizing a variance range or a variance width of the initial prosody pattern, bringing the variance range or the variance width of the initial prosody pattern to the same level as a variance range or a variance width of the prosody pattern of the training sentence in the speech corpus in accordance with the normalization parameters.

7. A prosody-pattern generating method comprising:

generating an initial prosody pattern based on language information and a prosody model which is obtained by modeling prosody information in units of phonemes, syllables, and words that constitute speech data;

generating, as normalization parameters, mean values and standard deviations of the initial prosody pattern and a prosody pattern of a training sentence included in a speech corpus, respectively;

storing the normalization parameters in a storing unit; and normalizing a variance range or a variance width of the initial prosody pattern, bringing the variance range or the variance width of the initial prosody pattern to the same level as a variance range or a variance width of the prosody pattern of the training sentence in the speech corpus in accordance with the normalization parameters.

* * * * *